US010340667B2

(12) United States Patent
Takeichi et al.

(10) Patent No.: US 10,340,667 B2
(45) Date of Patent: Jul. 2, 2019

(54) SPARK PLUG

(71) Applicant: NGK SPARK PLUG CO., LTD., Nagoya-shi, Aichi (JP)

(72) Inventors: Toshinori Takeichi, Komaki (JP); Kuniharu Tanaka, Komaki (JP); Hirokazu Kurono, Nagoya (JP); Haruki Yoshida, Tajimi (JP); Hironori Uegaki, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/156,337

(22) Filed: Oct. 10, 2018

(65) Prior Publication Data

US 2019/0115729 A1 Apr. 18, 2019

(30) Foreign Application Priority Data

Oct. 13, 2017 (JP) ..... 2017-198976

(51) Int. Cl.

| | |
|---|---|
| ***H01T 13/41*** | (2006.01) |
| ***H01T 13/34*** | (2006.01) |
| ***H01T 21/02*** | (2006.01) |

(52) U.S. Cl.

CPC ..... *H01T 13/41* (2013.01); *H01T 13/34* (2013.01); *H01T 21/02* (2013.01)

(58) Field of Classification Search

CPC ..... H01T 13/41; H01T 21/02; H01T 13/34

See application file for complete search history.

(56) References Cited

U.S. PATENT DOCUMENTS

2012/0262049 A1* 10/2012 Kurono ..... C04B 35/117 313/141

OTHER PUBLICATIONS

JP 2013-187049 A, Sep. 19, 2013, English language machine translation provided.

* cited by examiner

*Primary Examiner* — Donald L Raleigh

(74) *Attorney, Agent, or Firm* — Kusner & Jaffe

(57) ABSTRACT

A spark plug having a resistor disposed between a metal terminal and a center electrode so as to be electrically connected to the metal terminal and the center electrode, wherein the resistor is in contact with an inner circumferential surface of the insulator. On a cross section taken along the axial line so as to include the axial line, in a case where a plurality of points are plotted at predetermined intervals in a direction of the axial line so as to be present on a partial boundary line, within an arbitrary range in the direction of the axial line, of a boundary line between the insulator and the resistor, and a regression line is drawn by a least-squares method with use of the plurality of points, an average value of distances in a direction perpendicular to the regression line between the regression line and the partial boundary line is 0.1 to 0.3 μm.

7 Claims, 3 Drawing Sheets

SPARK PLUG

RELATED APPLICATIONS

This application claims the benefit of Japanese Patent Application No. 2017-198976, filed Oct. 13, 2017, the entire content of which is incorporated herein by reference.

FIELD OF THE INVENTION

The present invention relates to a spark plug, and particularly to a spark plug in which a resistor is included.

BACKGROUND OF THE INVENTION

A spark plug in which a resistor is included for suppressing electric wave noise to be generated when spark occurs, has been known (Japanese Patent Application Laid-Open (kokai) No. 2013-187049). The spark plug disclosed in Japanese Patent Application Laid-Open (kokai) No. 2013-187049 includes: an insulator having an axial hole; a center electrode and a metal terminal which are disposed on the front side and the rear side, respectively, of the axial hole; and a resistor disposed between the metal terminal and the center electrode in the axial hole so as to be electrically connected to the metal terminal and the center electrode. Discharge current when spark occurs flows into the resistor.

However, in the above-described conventional technology, the current density of the discharge current is increased at and near the interface between the insulator and the resistor owing to the skin effect. Thus, if the amount of heat generation of the resistor at and near the interface due to Joule heat is excessively increased, the resistor is easily deteriorated from a portion thereof at and near the interface.

The present invention addresses the above-described problem. An advantage of the present invention is a spark plug in which the durability of a resistor can be improved by suppressing deterioration thereof.

SUMMARY OF THE INVENTION

In accordance with a first aspect of the present invention, there is provided a spark plug that includes: an insulator having an axial hole extending along an axial line from a front side to a rear side; a center electrode disposed on the front side of the axial hole; a metal terminal disposed on the rear side of the axial hole; and a resistor disposed between the metal terminal and the center electrode in the axial hole so as to be electrically connected to the metal terminal and the center electrode, wherein the resistor is in contact with an inner circumferential surface of the insulator. On a cross section taken along the axial line so as to include the axial line, in a case where a plurality of points are plotted at predetermined intervals in a direction of the axial line so as to be present on a partial boundary line, within an arbitrary range in the direction of the axial line, of a boundary line between the insulator and the resistor, and a regression line is drawn by a least-squares method with use of the plurality of points, an average value of distances in a direction perpendicular to the regression line between the regression line and the partial boundary line is 0.1 to 0.3 μm.

In the spark plug according to a first aspect, on the cross section including the axial line, the average value of the distances between the regression line and the points on the partial boundary line between the insulator and the resistor is 0.1 to 0.3 μm, and thus it is possible to prevent excessive increase in the resistance of the resistor at and near the interface due to the roughness at the interface. Furthermore, an anchoring effect due to recesses and projections at the interface is obtained, whereby an interfacial fracture can be made less likely to occur. Therefore, the durability of the resistor can be improved.

In accordance with a second aspect of the present invention, there is provided a spark plug as described above, wherein in the insulator, a relative density is 94 to 98%, and thus the anchoring effect at the interface is obtained, whereby an interfacial fracture can be made further less likely to occur. In addition, in the insulator, a proportion of pores having diameters not smaller than 10 μm is not higher than 0.5%, and thus open pores of the insulator can be made less likely to exist at the interface between the insulator and the resistor. It is possible to prevent excessive increase in the resistance of the resistor at and near the interface from occurring as a result of the resistor entering the open pores of the insulator. Therefore, in addition to the effects in the first aspect, an effect of suppressing deterioration of the resistor due to heat generation can be improved.

In accordance with a third aspect of the present invention, there is provided a spark plug as described above, wherein the insulator has an alumina content not lower than 94 wt %, and thus the roughness at the interface can be easily reduced. As a result, the amount of heat generation of the resistor at and near the interface can be easily reduced. Therefore, in addition to the effects in the first or second aspect, deterioration of the resistor due to heat generation can be further suppressed.

In accordance with a fourth aspect of the present invention, there is provided a spark plug as described above, wherein the spark plug further includes a tubular metal shell which is disposed on an outer circumferential surface of the insulator and which has an outer circumferential surface having an external thread formed thereon. A nominal diameter of the external thread is not larger than 12 mm, and thus the insulator can be made thin in accordance with the metal shell. If the resistor included in the insulator is made thin in accordance with the thickness of the insulator, the ratio of the area of the interface (the outer circumferential surface of the resistor) to the volume of the resistor is increased as compared with a case where the resistor is thick. As a result, influence, of heat generation at and near the interface, relative to the volume of the resistor is increased as the resistor becomes thinner, and thus deterioration of the resistor due to heat generation easily occurs. On the contrary, in the spark plug according to the fourth aspect, the heat generation of the resistor at and near the interface can be suppressed by reducing the roughness of the interface, and thus, in addition to the effects in any of the first to third aspects, it is possible to improve the effect of suppressing deterioration of the resistor due to heat generation in the case where the nominal diameter of the external thread of the metal shell is not larger than 12 mm.

DETAILED DESCRIPTION OF THE INVENTION

Figure 1:
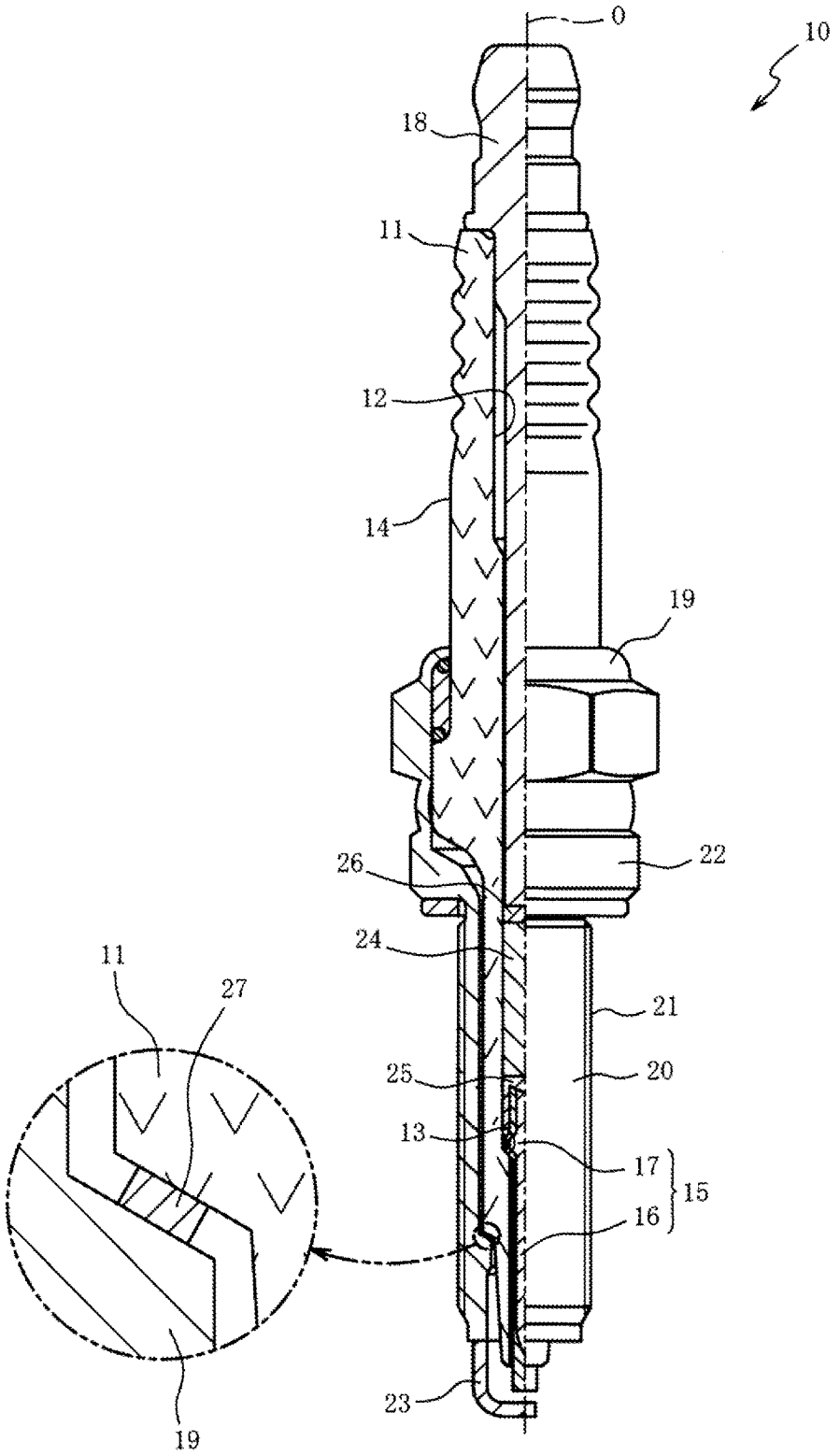
FIG. 1 is a half cross-sectional view of a spark plug according to one embodiment of the present invention.

Hereinafter, a preferred embodiment of the present invention will be described with reference to the accompanying drawings. FIG. 1 is a half cross-sectional view of a spark plug 10 according to one embodiment of the present invention, with an axial line O being the boundary. In FIG. 1, the lower side of the drawing sheet is referred to as a front side of the spark plug 10, and the upper side of the drawing sheet is referred to as a rear side of the spark plug 10. As shown in FIG. 1, the spark plug 10 includes an insulator 11, a center electrode 15, a metal terminal 18, and a metal shell 19.

The insulator 11 is a member formed from alumina or the like having excellent mechanical property and insulation property at a high temperature. The insulator 11 has an inner circumferential surface 12 formed as a result of an axial hole penetrating therethrough along the axial line O. On the front side, the inner circumferential surface 12 has a rearward-facing surface 13 which faces rearward. The rearward-facing surface 13 has an inner diameter that gradually reduces toward the front end.

The center electrode 15 is a rod-shaped member extending along the axial line O, and includes an axial portion 16 and a head portion 17 which has a larger outer diameter than the axial portion 16. The center electrode 15 is obtained by coating, with nickel or a nickel-based alloy, a core material made from copper or a core material that contains copper as a main component. Of the center electrode 15, the head portion 17 is engaged with the rearward-facing surface 13 of the inner circumferential surface 12 of the insulator 11, and the front end of the axial portion 16 is exposed from the axial hole of the insulator 11.

The metal terminal 18 is a rod-shaped member to which a high-voltage cable (not shown) is to be connected. The metal terminal 18 is formed from a conductive metal material (e.g., low-carbon steel or the like). The metal terminal 18 is fixed to the rear end of the insulator 11 in a state where the front side thereof is inserted in the axial hole of the insulator 11.

The insulator 11 has an outer circumferential surface 14 to which the metal shell 19 is fixed. The metal shell 19 is a substantially cylindrical member formed from a conductive metal material (e.g., low-carbon steel or the like). The metal shell 19 includes: a trunk portion 20 surrounding the outer circumference of the front side of the insulator 11; and a seat portion 22 which is contiguous to the rear side of the trunk portion 20 and which projects to the radially outer side relative to the trunk portion 20 so as to be flange-shaped. An external thread 21 is formed on the outer circumferential surface of the trunk portion 20. The metal shell 19 is fixed by being fastened into a screw hole (not shown) of an internal combustion engine (cylinder head) by the external thread 21. The nominal diameter of the external thread 21 is set to be not larger than 12 mm.

A part of the metal shell 19 is in contact with the front side in the direction of the axial line O of the insulator 11 via a packing 27, to fix the insulator 11. The packing 27 is an annular plate member formed from a metal material such as a mild steel plate milder than the metal material from which the metal shell 19 is formed.

A ground electrode 23 is a member that is made from a metal (e.g., a nickel-based alloy) and that is joined to the front end of the metal shell 19. In the present embodiment, the ground electrode 23 is formed so as to be rod-shaped, and has the front side that is bent so as to oppose the center electrode 15. A spark gap is formed between the ground electrode 23 and the center electrode 15.

A resistor 24 suppresses generation of a component, of discharge current, that is in a frequency band to which electric wave noise is attributed. As the resistor 24, a resistor obtained by mixing an aggregate and conductive powder is used. Examples of the aggregate of the resistor 24 include glass powder and inorganic compound powder. Examples of the glass powder as the aggregate include $B_2O_3$—$SiO_2$-based powder, BaO—$B_2O_3$-based powder, $SiO_2$—$B_2O_3$—CaO—BaO-based powder, $SiO_2$—ZnO—$B_2O_3$-based powder, $SiO_2$—$B_2O_3$—$Li_2O$-based powder, $SiO_2$—$B_2O_3$—$Li_2O$—BaO-based powder, and the like. Examples of the inorganic compound powder as the aggregate include powders made from alumina, silicon nitride, mullite, steatite, and the like. Among these types of the aggregate, a single type may be used alone, or two or more types may be used in combination.

Examples of the conductive powder of the resistor 24 include powders made from a semiconductive oxide, a metal, a non-metal conductive material, and the like. Examples of the semiconductive oxide include $SnO_2$. Examples of the metal include Zn, Sb, Sn, Ag, Ni, and the like. Examples of the non-metal conductive material include amorphous carbon (carbon black), graphite, silicon carbide, titanium carbide, titanium nitride, tungsten carbide, zirconium carbide, and the like. Among these types of the conductive powder, a single type may be used alone, or two or more types may be used in combination.

A conductor 25 is a conductive member for sealing and fixing the head portion 17 of the center electrode 15 with respect to the inner circumferential surface 12 of the insulator 11. A connection portion 26 is a member for electrically connecting the resistor 24 and the metal terminal 18 to each other. As the conductor 25 and the connection portion 26, a conductor and a connection portion obtained by baking mixtures of glass powder and conductive powder are used. As the glass powder and the conductive powder, the same glass powder and conductive powder as those that are the materials of the resistor 24 are used. The conductor 25 and the connection portion 26 may contain, as necessary, semiconductive inorganic compound powder, insulative powder, etc., of $TiO_2$ or the like. The resistor 24 is electrically connected to the center electrode 15 and the metal terminal 18 by the conductor 25 and the connection portion 26.

The spark plug 10 is manufactured by the following method, for example. First, the center electrode 15 is inserted in the axial hole of the insulator 11 such that the head portion 17 of the center electrode 15 is engaged with the rearward-facing surface 13. Then, a raw material powder of the conductor 25 is put into the axial hole so as to be filled around the head portion 17. A compression bar member (not shown) is used to preliminarily compress the raw material powder filled around the head portion 17. Then, a raw material powder of the resistor 24 is put into the axial hole so as to be filled rearward of the raw material powder of the conductor 25. The compression bar member (not shown) is used to preliminarily compress the raw material powders filled in the axial hole. Then, a raw material powder of the connection portion 26 is put into the axial hole so as to be filled rearward of the raw material powder of the resistor 24. The compression bar member (not shown) is used to preliminarily compress the raw material powders filled in the axial hole.

Then, the insulator 11 is transferred into a furnace, and is heated to, for example, a temperature higher than the softening points of glass components contained in the raw material powders. After the raw material powders are softened, the softened raw material powders are compressed in the direction of the axial line O by the metal terminal 18 inserted in the axial hole of the insulator 11. As a result, the raw material powders are compressed and sintered, so that the conductor 25, the resistor 24, and the connection portion 26 are formed in the axial hole.

Next, the insulator 11 is inserted in the metal shell 19 having the ground electrode 23 joined thereto in advance, and the metal shell 19 is assembled to the insulator 11. The ground electrode 23 is bent such that the distal end of the ground electrode 23 opposes the center electrode 15, thereby obtaining the spark plug 10.

The insulator 11 contains Al, Si, Ba, a rare earth element, and the like. The insulator 11 has an $Al_2O_3$ (alumina) content of 94 to 97 wt %. Accordingly, sinterability can be ensured and satisfactory mechanical strength and voltage resistance can be obtained. A quantitative analysis of elements contained in the insulator 11 is performed by means of, for example, an ICP emission spectroscopic analysis, an ICP mass analysis, and the like. A composition analysis of the insulator 11 is performed by means of an X-ray diffraction method.

Each of the Si component and the Ba component is a component derived from a sintering additive, and is ordinarily melted to form a liquid phase when the insulator 11 is sintered, thereby functioning as a sintering additive for facilitating densification of the insulator 11. The insulator 11 can contain an alkaline earth metal such as Mg and Ca other than Ba. Each of the Mg component and the Ca component functions as a sintering additive as does the Ba component.

The rare earth component is a component derived from a sintering additive, and includes Sc, Y, La, Ce, Pr, Nd, Pm, Sm, Eu, Gd, Tb, Dy, Ho, Er, Tm, Yb, and Lu. The rare earth component suppresses abnormal particle growth of alumina at the time of sintering, to ensure the mechanical strength of the insulator. A component including Y, La, Pr, Nd, and Yb can be easily used, and thus is preferable as the rare earth component. The insulator 11 may contain other elements such as inevitable impurities without deviating from the object of the present invention. Examples of such other elements include Na, S, N, B, Ti, Cr, Mn, Fe, Co, Ni, and the like.

The insulator 11 is obtained by baking a molded body. The molded body is obtained as follows: slurry obtained by mixing a raw material powder of the insulator 11, a binder, a solvent, and the like is sprayed and dried so that a spherically granulated substance is obtained, and thereafter, this granulated substance is molded by any means such as a rubber press, a die press, or the like, for example. The outer surface of the obtained molded body is ground with use of a resinoid grinding wheel or the like, to be adjusted in shape, and thereafter, the molded body is baked.

Figure 2:
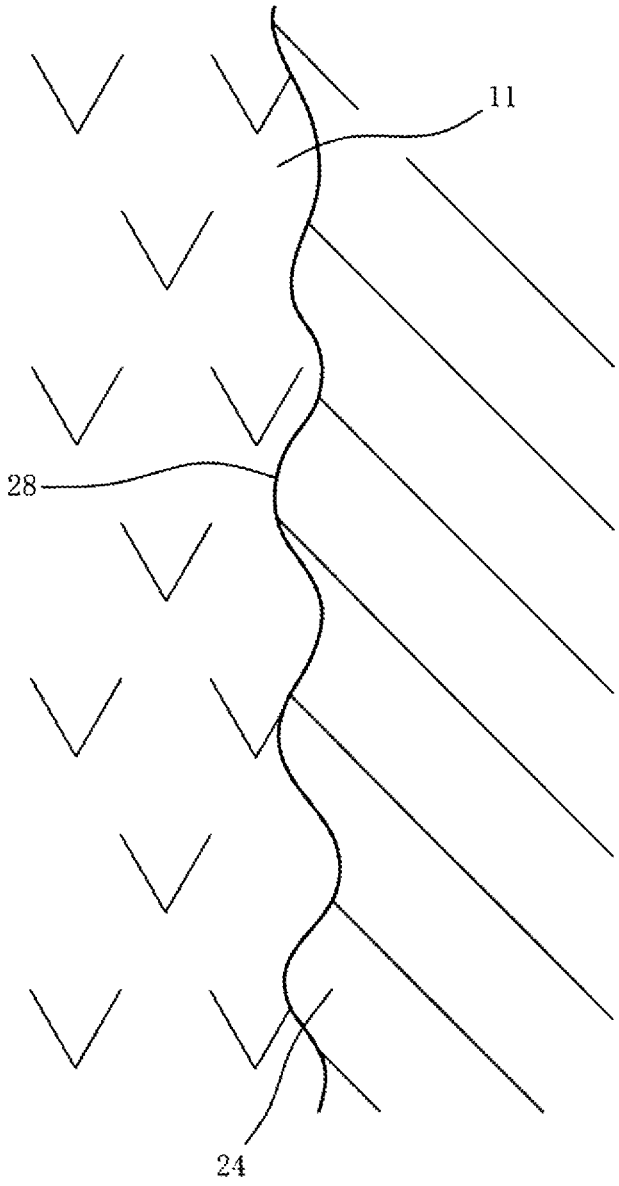
FIG. 2 is a cross-sectional view of the spark plug, showing a boundary line between an insulator and a resistor.

FIG. 2 is a cross-sectional view of the spark plug 10, showing a boundary line 28 between the insulator 11 and the resistor 24. The resistor 24 is formed as follows: after the raw material powder of the resistor 24 is filled in the axial hole of the insulator 11, the insulator 11 is heated, thereby softening the raw material powder of the resistor 24. Therefore, the boundary line 28 between the insulator 11 and the resistor 24 is formed as a result of the resistor 24 being fitted along a portion, of the inner circumferential surface 12 of the insulator 11, with which the resistor 24 is in contact. Therefore, a roughness at the boundary line 28 is dependent on the surface roughness of the inner circumferential surface 12 of the insulator 11. The boundary line 28 is a line that appears on a cross section obtained by cutting the insulator 11 and the resistor 24 along a plane (the surface of the sheet of FIG. 1) including the axial line O (see FIG. 1), and is a part of the interface between the insulator 11 and the resistor 24.

The surface roughness of the inner circumferential surface 12 of the insulator 11 can be controlled through setting of: a particle size distribution of the raw material powder of the insulator 11; the surface roughness of a core, a pin, or the like for forming the axial hole of the molded body of the insulator 11; and the like. By reducing the particle diameters of the raw material powder of the insulator 11, and performing specular machining on the surface of the core, the pin, or the like, the surface roughness of the inner circumferential surface 12 of the insulator 11 can be reduced.

Figure 3:
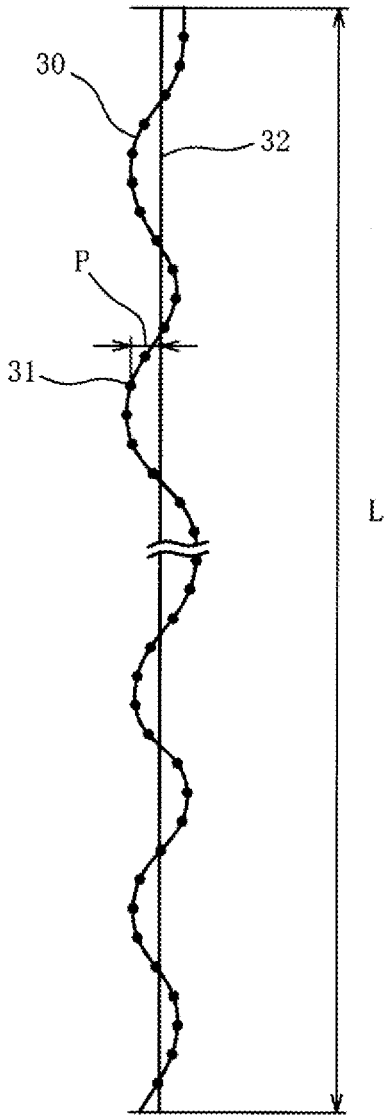
FIG. 3 is a partial boundary line, within an arbitrary range, of the boundary line between the insulator and the resistor.

FIG. 3 shows a partial boundary line 30 (a part of the boundary line 28), within an arbitrary range in the direction of the axial line O, of the boundary line 28 between the insulator 11 and the resistor 24. Hereinafter, an analysis method for the partial boundary line 30 will be described. Analysis of the partial boundary line 30 is performed with use of, for example, image analysis software WinROOF 2013 (manufactured by MITANI CORP.) on the basis of an image obtained by means of a microscope such as an SEM or the like. A reference length L (the length in the direction of the axial line O (the up/down direction in FIG. 3) of the partial boundary line 30) used for analyzing the partial boundary line 30, is set to 50 μm.

First, in order to convert the partial boundary line 30 into data in a digital format, a plurality of points 31 are plotted on the partial boundary line 30 at predetermined intervals in the direction of the axial line O. In the present embodiment, each interval in the direction of the axial line O between the points 31 is set to 0.7 μm. Then, a regression line 32 is obtained by a least-squares method with use of the plurality of points 31. Then, all the distances P (distances in a direction perpendicular to the regression line 32) between the regression line 32 and the respective plurality of points 31 on the partial boundary line 30 are measured, and the average value of all the measurement values is obtained. In the spark plug 10, the average value is set to 0.1 to 0.3 μm.

It is noted that the points 31 on the partial boundary line 30 at each of which the distance P between the regression line 32 and the partial boundary line 30 is obtained, may be the same points as the points 31 used when the regression line 32 is obtained, or may be points different from the points 31 used when the regression line 32 is obtained. This is because, since all the points 31 are present on the partial boundary line 30, the average value of the distances P measured with use of the same points as the points 31 used when the regression line 32 is obtained, is approximately the same value as the average value of the distances P measured with use of points different from the points 31 used when the regression line 32 is obtained.

Here, the spark plug 10 suppresses electric wave noise by discharge current flowing through the resistor 24 when spark occurs. Owing to the skin effect, the current density of the discharge current is higher at and near the interface (boundary line 28) than at and near the center of the resistor 24. If the amount of heat generation of the resistor 24 at and near the interface is excessively increased owing to Joule heat, the resistor 24 is easily deteriorated from a portion thereof at and near the interface.

If the insulator 11 and the resistor 24 are fitted to each other along the interface (boundary line 28) and the roughness at the interface is increased, the resistance of the resistor 24 at and near the interface tends to be higher. Thus, the amount of heat generation at and near the interface is likely to increase, and the lifespan of the resistor 24 is likely to be shortened. On the other hand, if the roughness at the interface is reduced, the resistance of the resistor 24 at and near the interface decreases. However, the anchoring effect due to recesses and projections at the interface tends to be poor, whereby an interfacial fracture easily occurs.

On the contrary, in the spark plug 10, since the average value of the distances P between the regression line 32 and the respective points 31 on the partial boundary line 30 is set to 0.1 to 0.3 μm, it is possible to prevent excessive increase in the resistance of the resistor 24 at and near the interface (boundary line 28) due to the roughness at the interface. Accordingly, it is possible to suppress heat generation of the resistor 24 at and near the interface and suppress deterioration of the resistor 24. Furthermore, the anchoring effect due to the recesses and projections at the interface can be obtained, whereby an interfacial fracture can be made less likely to occur. Therefore, the durability of the resistor 24 can be improved.

If the insulator 11 has a relative density of 94 to 98%, the roughness at the interface (boundary line 28) is prevented from excessively increasing, and an anchoring effect at the interface is easily obtained as a result of the resistor 24 entering the inner circumferential surface 12 of the insulator 11, whereby an interfacial fracture can be made further less likely to occur. The relative density is a value obtained by dividing, by a theoretical density, a density obtained through an experiment (performed by the Archimedes' method). In obtaining of the theoretical density, quantitative analysis of elements, other than Al, contained at not lower than 0.1 wt % in the insulator 11 is performed by means of the ICP emission spectroscopic analysis and the ICP mass analysis, and calculation is performed with the other being determined as alumina.

In the insulator 11, the proportion of pores (hereinafter, referred to as "porosity") having diameters not smaller than 10 μm is not higher than 0.5%. Calculation of the porosity is performed with use of, for example, image analysis software WinROOF 2013 (manufactured by MITANI CORP.) on the basis of an image obtained by means of a microscope such as an SEM or the like. The porosity is a value obtained by dividing the sum of the areas of pores having diameters not smaller than 10 μm and enclosed by the insulator 11 present within a field of view, by the sum of the area of the insulator 11 and the areas of the pores (i.e., the area of the field of view). As the diameter of each pore, the diameter of a circle (circle-equivalent diameter) having an area that is equal to that of a cross section of the pore present within the field of view, is used.

Since the porosity of pores having diameters not smaller than 10 μm is set to be not higher than 0.5%, open pores of the insulator 11 can be made less likely to exist at the interface with the resistor 24. As a result, the resistor 24 (mainly, a glass component) can be made less likely to enter the open pores present in the insulator at the interface, and thus it is possible to prevent excessive increase in the resistance of the resistor 24 at and near the interface. Therefore, the effect of suppressing deterioration of the resistor 24 due to heat generation can be improved.

The insulator 11 has an alumina content not lower than 94 wt %, and thus the roughness of the resistor 24 at the interface can be easily reduced as compared to the case of an insulator having a low alumina content. As a result, the amount of heat generation of the resistor 24 at and near the interface can be easily reduced, whereby deterioration of the resistor 24 due to heat generation can be further suppressed.

On the metal shell 19 disposed on the outer circumferential surface 14 of the insulator 11, the nominal diameter of the external thread 21 is not larger than 12 mm. Therefore, the insulator 11 held by the metal shell 19 can be made thin in accordance with the metal shell 19. If the resistor 24 included in the insulator 11 is made thin in accordance with the thickness of the insulator 11, the ratio of the area of the interface (the outer circumferential surface of the resistor 24) to the volume of the resistor 24 is increased as compared with a case where the resistor 24 is thick. As a result, influence, of heat generation at and near the interface, relative to the volume of the resistor 24 is increased as the resistor 24 becomes thinner, and thus deterioration of the resistor 24 due to heat generation easily occurs. On the contrary, in the spark plug 10, heat generation of the resistor 24 at and near the interface can be suppressed, and thus it is possible to improve the effect of suppressing deterioration of the resistor 24 due to heat generation particularly in the case where the nominal diameter of the external thread 21 of the metal shell 19 is not larger than 12 mm.

EXAMPLES

The present invention will be described further in details on the basis of examples, but the present invention is not limited to the examples.

As shown in table 1, an examiner prepared samples 1 to 15 on the basis of the spark plug 10 described in the embodiment. The following values varied among samples 1 to 15: the average value of the distances P between the regression line 32 and the respective points 31 on the partial boundary line 30; the relative density of the insulator 11; the porosity with diameters being not smaller than 10 μm and enclosed by the insulator 11; the alumina content of the insulator 11; and the nominal diameter of the external thread 21 of the metal shell 19. In order to research the influence of these parameters, parameters other than these parameters were set to be equal among samples 1 to 15.

TABLE 1

| No. | Average value of distances (μm) | Insulator relative density (%) | Porosity (≥Φ10 μm) (%) | Alumina content (wt %) | External thread nominal diameter (mm) | Evaluation (point) |
|---|---|---|---|---|---|---|
| 1 | 0.08 | 97.4 | 0.35 | 96.7 | 12 | 1 |
| 2 | 0.35 | 97.7 | 0.31 | 96.7 | 12 | 1 |
| 3 | 0.15 | 93.6 | 0.58 | 96.7 | 12 | 4 |
| 4 | 0.16 | 98.2 | 0.13 | 96.7 | 12 | 5 |
| 5 | 0.14 | 97.3 | 0.30 | 93.0 | 12 | 5 |
| 6 | 0.30 | 97.4 | 0.35 | 96.7 | 12 | 7 |
| 7 | 0.10 | 97.5 | 0.35 | 96.7 | 12 | 7 |
| 8 | 0.16 | 98.0 | 0.20 | 96.7 | 12 | 8 |
| 9 | 0.16 | 94.0 | 0.50 | 96.7 | 12 | 8 |
| 10 | 0.15 | 97.5 | 0.31 | 98.0 | 12 | 7 |
| 11 | 0.16 | 97.5 | 0.33 | 97.0 | 12 | 8 |
| 12 | 0.15 | 97.7 | 0.30 | 94.0 | 12 | 8 |
| 13 | 0.15 | 97.4 | 0.34 | 96.7 | 12 | 8 |
| 14 | 0.16 | 97.5 | 0.33 | 96.7 | 8 | 9 |
| 15 | 0.16 | 97.5 | 0.33 | 96.7 | 6 | 10 |

The thickness of the metal shell 19 was set to be equal among samples 1 to 15, and the insulator 11 of each of samples 14 and 15 in which the nominal diameter of the external thread 21 of the metal shell 19 was reduced, was set to have a smaller thickness than the insulator 11 of each of samples 1 to 13. In addition, the surface roughness of a pin for preparing a molded body of the insulator 11 by means of press-molding was set to be different among samples 1 to 15, so that the average value of the distances P between the regression line 32 and the respective points 31 on the partial boundary line 30 became different thereamong.

This average value was obtained with the partial boundary line 30 having a reference length of 50 μm, and is the average (the unit is μm) of the distances P between the regression line 32 and the plurality of respective points 31 on the partial boundary line 30 plotted at intervals of 0.7 μm. In this example, the points 31 on the partial boundary line 30 at each of which the distance P between the regression line 32 and the partial boundary line 30 was obtained were the same points as the points 31, on the partial boundary line 30, which was used when the regression line 32 was obtained. However, the points 31 at each of which the distance P is obtained may be points different from the points 31 used when the regression line 32 is obtained. The average value was rounded to the second decimal place.

For each sample, DC voltage of 5V was applied between the metal terminal 18 and the center electrode 15, to measure the resistance value, and, with use of a resistance-temperature characteristic measured in advance, the measurement value obtained at that time was corrected to a resistance value to be obtained at 20° C. Then, with each sample being placed under an environment at 350° C. and with the spark discharge voltage being set to 25 kV, a test was performed in which sparks were emitted between the center electrode 15 and the ground electrode 23 at a rate of 3600 times per minute for a predetermined time period. After the test, the sample was left for one hour, the resistance value was measured in the same manner as that before the test, and the measurement value obtained at that time was corrected to a resistance value to be obtained at 20° C. The time period (hereinafter, referred to as "lifespan (hours)") taken until the resistance value after the test became not less than 1.5 times the resistance value before the test, was measured.

The test was performed on 10 pieces of each sample, and the average value of the lifespans (hours) obtained as a result of the test performed 10 times, was evaluated by being represented as a point according to the following criterion.

1 point: the lifespan (hours) was less than 150 hours.

2 points: the lifespan (hours) was not less than 150 hours and less than 200 hours.

3 to 9 points: the lifespan (hours) was not less than 200 hours and less than 550 hours (samples with the lifespan (hours) being not less than 200 hours and less than 250 hours was scored 3 points, and 1 point was added each time the lifespan (hours) was increased by 50 hours).

10 points: the lifespan (hours) was not less than 550 hours.

Higher points indicate that the lifespan (hours) is longer and the durability is more excellent.

After this test, each sample was cut along a plane that was orthogonal to the axial line O and that passed the front end of the packing 27, so that the cut surface of the insulator 11 was exposed. The insulator 11 having the cut surface exposed was embedded in a thermoplastic resin, and mirror polishing was performed on the cut surface. The polished surface having undergone the mirror polishing was observed by means of a scanning electron microscope (SEM), and, with use of image analysis software, the proportion of pores (porosity) having diameters not smaller than 10 μm was obtained.

As shown in table 1, sample 1 in which the average value of the distances was smaller than 0.10 μm, and sample 2 in which the average value was larger than 0.30 μm, were evaluated as 1 point. It is assumed that the resistors in sample 1 and sample 2 were deteriorated exceedingly early as a result of sample 1 having suffered an interfacial fracture and sample 2 having suffered heat generation of the resistor at and near the interface.

Sample 3 in which the relative density of the insulator was lower than 94.0% and the porosity with diameters being not smaller than 10 μm was higher than 0.50%, was evaluated as 4 points. Sample 4 in which the relative density of the insulator was higher than 98.0%, was evaluated as 5 points. It is assumed that the resistors in samples 3 and 4 were deteriorated earlier than in samples 6 to 15 owing to heat generation of the resistors at and near the interfaces.

Sample 5 in which the alumina content of the insulator was lower than 94.0%, was evaluated as 5 points. It is assumed that the resistor in sample 5 was deteriorated earlier than in samples 6 to 15 owing to heat generation of the resistor at and near the interface.

It has been found that the lifespan (hours) not less than 450 hours can be ensured in samples 6 to 15. The nominal diameter of the external thread of the metal shell was 6 to 12 mm in each of samples 6 to 15. In this example, it has been found that the lifespan (hours) of the resistor can be significantly elongated by setting the average value of the distances P between the regression line 32 and the respective points 31 on the partial boundary line 30 to 0.10 to 0.30 μm.

As described above, although the present invention has been described based on the embodiment, the present invention is not limited to the above-described embodiment at all. It can be easily understood that various modifications can be devised without departing from the gist of the present invention. For example, as a matter of course, the molded body of the insulator 11 may be obtained by means of injection molding instead of press-molding. In a case where the molded body is obtained by means of injection molding, a shape-adjusting step performed through grinding and polishing after the molding can be omitted, and thus the injection molding is preferable.

In the embodiment, the case has been described where the insulator 11 contains Si, Ba, and a rare earth element, and the $Al_2O_3$ content is 94 to 97 wt %. However, the present invention is not limited thereto. As a matter of course, an insulator 11 in which one or more of Si, Ba, and a rare earth element are omitted, or an insulator 11 in which the $Al_2O_3$ content is higher than 97 wt %, may be used in accordance with the specifications of the spark plug 10.

In the embodiment, the case has been described where the resistor 24 is connected to the metal terminal 18 by the connection portion 26 formed from a conductive glass. However, the present invention is not limited thereto. For example, as a matter of course, instead of the conductive glass, an elastic body (connection portion) such as a conductive spring may be interposed between the resistor 24 and the metal terminal 18 so as to electrically connect the resistor 24 and the metal terminal 18 to each other.

In the embodiment, the case has been described where the ground electrode 23 joined to the metal shell 19 is bent. However, the present invention is not limited thereto. As a matter of course, instead of using the bent ground electrode 23, a linear ground electrode 23 may be used. In this case, the front side of the metal shell 19 is extended in the direction of the axial line O, and the linear ground electrode 23 is joined to the metal shell 19 such that the distal end of the ground electrode 23 opposes the center electrode 15.

In the embodiment, the case has been described where the ground electrode 23 is disposed such that the distal end of the ground electrode 23 and the center electrode 15 oppose each other on the axial line O. However, the present invention is not limited thereto. The positional relationship between the ground electrode 23 and the center electrode 15 may be set as appropriate. Examples of another positional relationship between the ground electrode 23 and the center electrode 15 include one in which the ground electrode 23 is disposed such that a side surface of the center electrode 15 and the distal end of the ground electrode 23 oppose each other.

In the embodiment, the case has been described where a single ground electrode 23 is joined to the metal shell 19. However, the present invention is not limited thereto. As a matter of course, a plurality of the ground electrodes 23 may be joined to the metal shell 19.

DESCRIPTION OF REFERENCE NUMERALS

10: spark plug
11: insulator
12: inner circumferential surface
14: outer circumferential surface
15: center electrode
18: metal terminal
19: metal shell
21: external thread
24: resistor
28: boundary line
30: partial boundary line
31: point
32: regression line
P: distance Having described the invention, the following is claimed:

1. A spark plug comprising:

an insulator having an axial hole extending along an axial line from a front side to a rear side;

a center electrode disposed on the front side of the axial hole;

a metal terminal disposed on the rear side of the axial hole; and a resistor disposed between the metal terminal and the center electrode in the axial hole so as to be electrically connected to the metal terminal and the center electrode, wherein the resistor is in contact with an inner circumferential surface of the insulator, and, on a cross section taken along the axial line so as to include the axial line, in a case where a plurality of points are plotted at predetermined intervals in a direction of the axial line so as to be present on a partial boundary line, within an arbitrary range in the direction of the axial line, of a boundary line between the insulator and the resistor, and a regression line is drawn by a least-squares method with use of the plurality of points, an average value of distances in a direction perpendicular to the regression line between the regression line and the partial boundary line is 0.1 to 0.3 μm.

2. The spark plug according to claim 1, wherein, in the insulator, a relative density is 94 to 98%, and a proportion of pores having diameters not smaller than 10 μm is not higher than 0.5%.

3. The spark plug according to claim 1, wherein the insulator has an alumina content not lower than 94 wt %.

4. The spark plug, according to claim 2, wherein the insulator has an alumina content not lower than 94 wt %.

5. The spark plug according claim 1, the spark plug further comprising a tubular metal shell which is disposed on an outer circumferential surface of the insulator and which has an outer circumferential surface having an external thread formed thereon, wherein a nominal diameter of the external thread is not larger than 12 mm.

6. The spark plug according claim 2, the spark plug further comprising a tubular metal shell which is disposed on an outer circumferential surface of the insulator and which has an outer circumferential surface having an external thread formed thereon, wherein a nominal diameter of the external thread is not larger than 12 mm.

7. The spark plug according claim 3, the spark plug further comprising a tubular metal shell which is disposed on an outer circumferential surface of the insulator and which has an outer circumferential surface having an external thread formed thereon, wherein a nominal diameter of the external thread is not larger than 12 mm.

* * * * *